US005617697A

United States Patent [19]

Erwin

[11] Patent Number: 5,617,697

[45] Date of Patent: Apr. 8, 1997

[54] COMPOSITE DECK POST

[75] Inventor: Ronald D. Erwin, Fayetteville, Ga.

[73] Assignee: Erwin Industries, Inc., Peachtree City, Ga.

[21] Appl. No.: 582,510

[22] Filed: Jan. 3, 1996

[51] Int. Cl.[6] ..... E04C 3/30

[52] U.S. Cl. ..... 52/737.4; 52/79.6; 52/720.2; 52/730.4; 52/736.3; 52/738.1; 256/19; 256/66; 256/DIG. 5; 256/DIG. 6; 403/230

[58] Field of Search ..... 52/730.1, 720.2, 52/730.4, 732.1, 732.3, 736.1, 736.3, 737.4, 738.1, 299, 191, 182, 184, 79.6, 650.3, 651.1, 651.07, 653.2; 256/19, 65, 66, DIG. 5, DIG. 6; 403/230, 245

[56] References Cited

U.S. PATENT DOCUMENTS

| | | | |
|---|---|---|---|
| 1,903,907 | 4/1933 | Riemenschneider | 52/730.1 X |
| 3,131,792 | 5/1964 | Groneman et al. | 52/732.1 X |
| 3,200,554 | 8/1965 | Goodman et al. | 52/720.2 |
| 3,917,368 | 11/1975 | Gusdorf et al. | 52/732.3 X |
| 4,038,802 | 8/1977 | Bajorek et al. | 52/720.2 |
| 4,269,545 | 5/1981 | Finney | 256/19 X |
| 4,461,461 | 7/1984 | Caron | 256/19 |
| 4,691,484 | 9/1987 | Wilson | 52/79.6 |
| 4,702,459 | 10/1987 | Moschner | 256/19 |
| 4,918,880 | 4/1990 | Carney | 52/79.6 X |
| 4,955,173 | 9/1990 | Czechowski | 52/737.4 |
| 5,458,942 | 10/1995 | Miller | 52/738.1 X |
| 5,471,809 | 12/1995 | Frankel | 52/737.4 |
| 5,528,870 | 6/1996 | Zamerovsky | 52/650.3 X |

FOREIGN PATENT DOCUMENTS

| | | | |
|---|---|---|---|
| 1540643 | 9/1968 | France | 256/DIG. 6 |
| 2540923 | 8/1984 | France | 52/182 |

*Primary Examiner*—Carl D. Friedman
*Assistant Examiner*—Laura A. Saladino
*Attorney, Agent, or Firm*—Arthur A. Gardner & Associates

[57] ABSTRACT

A composite deck post for use with a wood joist of a wood deck and for attachment thereto with at least one fastener. The composite deck post comprises an elongate, hollow extruded plastic shell which is rectangular in cross-section and has an upper end and a lower end. The shell has a rectangular notch formed therein adjacent the lower end for receiving a wood joist of a deck. An elongate tubular metal stiffening member is positioned within the plastic shell and is rigidly secured thereto generally adjacent the upper end of the plastic shell. The plastic shell and the metal stiffening member each have at least one mounting hole co-aligned with each other for mounting the composite deck post to the wood joist with a fastener.

3 Claims, 1 Drawing Sheet

COMPOSITE DECK POST

TECHNICAL FIELD

The present invention is directed to decking, and in particular to posts for decking.

BACKGROUND OF THE INVENTION

Outdoor decks are extremely popular in residential home construction. Homes and apartments, as well as a variety of other buildings, often incorporate exterior decks into their design. Additionally, decks are commonly added onto existing structures and landscapes. These decks provide convenient spaces for a variety of outdoor activities, including cookouts, dining and sunbathing, as well as other leisure activities. Moreover, decks typically are provided with a railing or perimeter fence to keep people from falling over the edge of the deck.

Wood products have traditionally been the primary source of materials for use in decking construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of wood products. With the diminishing availability of timber resources, wood products are becoming increasingly expensive. There is, therefore, a substantial need for long lasting substitute construction materials that can lessen the need to harvest timber resources.

One potential approach to addressing the above need is to provide substitute decking products made of plastic, rather than wood. However, because the deck products must be capable of sustaining certain loads, the replacement products need to be stable and rigid. The material should also be capable of economical manufacture, and be relatively inexpensive. It also needs to be easily installed and used in the field.

A variety of plastic building products are known. For example, U.S. Pat. No. 4,045,603 describes a three-layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits.

U.S. Pat. No. 3,764,245 describes an apparatus for producing a light structural board of thermoplastic resin.

U.S. Pat. No. 5,253,458 describes a simulated log made from a cast polyvinylchloride (PVC) pipe, selectively filled with a hard cast foam or bead type foam. This patent further describes that the cast PVC pipe is first manufactured and then subsequently filled with the foam filler.

Accordingly, it can be seen there is a need yet in the art for replacement decking components as a replacement for traditional wood products, which provide a strong finished product at minimal cost, which are weather resistant and which can be produced and installed easily. It to the provision of such decking components that the present invention is primarily directed.

SUMMARY OF THE INVENTION

Briefly described, in a preferred Form the present invention comprises a composite deck post for use with a wood joist of a wood deck and for attachment thereto with at least one fastener. The composite deck post comprises an elongate, hollow extruded plastic shell having a rectangular cross-section and having an upper end and a lower end opposite the lower end. The plastic shell has a rectangular notch formed therein adjacent the lower end for receiving a wood joist of a wood deck. An elongate tubular metal stiffening member is positioned within the plastic shell and is rigidly secured thereto generally adjacent the upper end of the plastic shell. The plastic shell has at least one pre-formed mounting hole adjacent the notch for mounting the post to the wood joist with a fastener. The metal stiffening member also has at least one pre-formed mounting hole aligned with the at least one mounting hole of the plastic shell.

With this construction, a homeowner or builder can quickly and easily attach the composite deck post to the wood joist simply by positioning it over the wood joist, drilling through the wood joist using the pre-formed mounting hole(s) as a guide for the drill, and then screwing or bolting the composite deck post to the wood joist. The resulting structure, which is easily manufactured and installed, is very strong, sturdy, and weatherable.

Preferably, two pre-formed mounting holes are formed in the plastic shell and the metal stiffening member, one above the other. Also, preferably the metal stiffening member is made of steel and has a square cross-section.

With this construction, a deck post is provided which is very easy to manufacture, which provides excellent appearance, and which provides good strength (both in terms of bending resistance and compression load carrying capability). This composite deck post represents a good alternative to the use of traditional wood posts.

Accordingly, it is an object of the present invention to provide a composite deck post which is economical in manufacture and application, durable in construction, and simple.

It is another object of the invention to provide a composite deck post which has good strength and rigidity for use in deck railings.

These and other objects, advantages, and features of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENT

Figure 1:
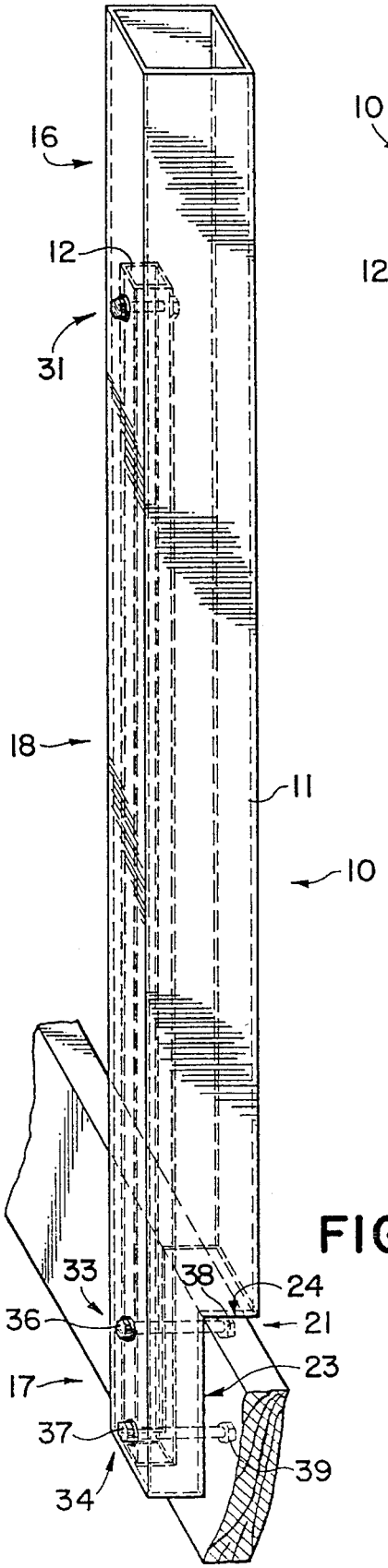
FIG. 1 is a perspective illustration of a composite deck post according to a preferred form of the invention.
Figure 3:
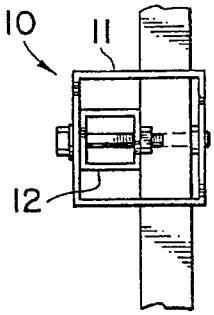
FIG. 3 is a plan view of the composite deck post of FIG. 1.
Figure 2:
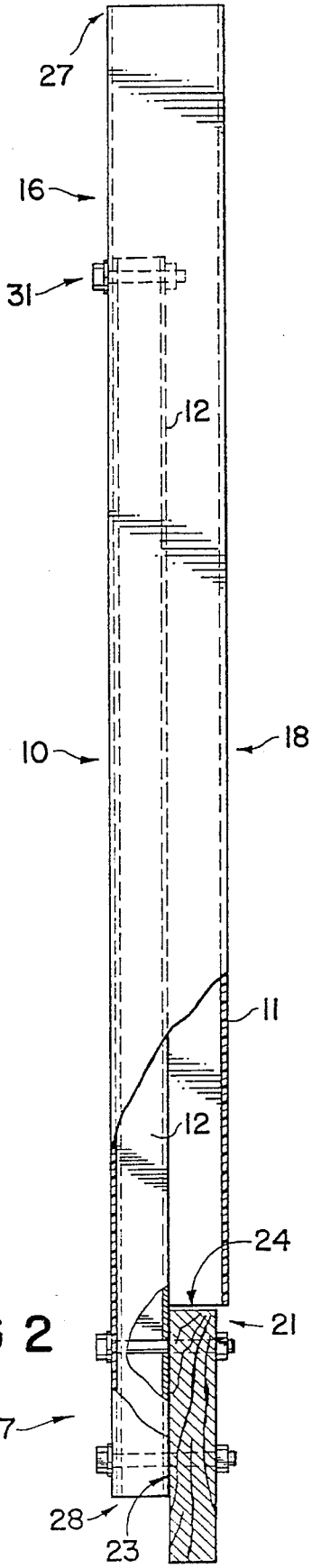
FIG. 2 is a partially cut-away, side view of the composite deck post of FIG. 1.

Referring now to the drawing figures, wherein like reference numerals depict like parts throughout the several views, FIGS. 1 through 3 show a composite deck post 10 according to a preferred form of the invention. The composite deck post 10 generally comprises a rigid plastic outer shell 11 and a steel tubular reinforcing element 12. Preferably, the outer shell is made of PVC (polyvinylchloride).

The PVC outer shell 11 includes a first (upper) end section 16, a second (lower) end section 17 opposite the first end section 16, and an intermediate section 18 between the first and second end sections. As depicted in the drawing figures, preferably the plastic outer shell 11 has a square cross-section (best seen in FIG. 3). Other rectangular shapes would work also. The square PVC outer shell 11 is made as an extrusion and is then cut to length. At the lower end 17 of the outer shell 11 a notch is formed for mounting the deck post to a wood joist of a wood deck. The notch 21 is rectangular for receiving a wood joist and is formed by making two saw cuts (at right angles to one another) in the lower end 17 of the plastic outer shell 11. The notch 21 includes a cheek or face 23 and a shoulder 24. Preferably, the plastic shell has a wall thickness of 0.150 inches and a maximum dimension of 43 inches from the upper face or edge 27 to the lower face or edge 28. Preferably, the notch 21 has a height of 5½ inches. The thickness of the notch preferably is chosen to allow the lower end of the PVC outer shell 11 to be tightly bolted to the joist without crushing the lower end of the outer shell (i.e., the notch is large enough so that the steel stiffener is flush with the check 23 or is slightly proud thereof.) For example, in the illustrative example described, the depth of the notch is chosen to leave a 1.400 inch thick leg (equal to the wall thickness of the shell plus the transverse dimension of the steel tubing).

The metal reinforcing element 12 is a piece of G-90 galvanized square tubing which is 1.250 inches square with a wall thickness of 0.100 inches. The metal reinforcing tube 12 is 39 inches long and is rigidly secured to an inside face of the plastic outer shell 11 by an aluminum fastener 31 which is painted white. The fastener depicted is in the form of a nut and bolt, but other fastener means could be employed. The fastener, in particular the bolt portion thereof, extends through pre-formed holes in the plastic outer shell 11 and the square steel tubing 12. The square metal reinforcing element 12 does not extend all the way to the top edge 27 of the plastic reinforcing shell 11, in order to allow lateral side rails to be mounted to and extended into the upper-most portion of the plastic shell 11. In this way, the steel reinforcing element stays clear of lateral rails to allow the composite deck post to be connected with side rails.

At the lower end 17 of the plastic shell, the plastic shell and the steel reinforcing element are bolted to a wood joist using a pair of fasteners 33 and 34. In particular, these fasteners preferably take the form of aluminum bolts 36, 37 and nuts 38, 39 painted white (screws or other fasteners could be used). The bolts are threaded through pre-formed holes in the plastic shell 11 and the metal reinforcing element 12. The holes in the outer plastic shell 11 are aligned with the holes in the reinforcing element 12.

It is anticipated that in a typical use, the composite deck post is sold partially pre-assembled, with the metal reinforcing element 12 already inserted in and mounted to the plastic outer shell 11. The metal reinforcing element 12 is secured with the upper bolt 31 only. Neither of the lower fasteners 33 or 34 are installed at the factory. Instead, the user/installer would position the composite deck post on a joist and use the pre-formed holes in the plastic outer shell 11 and the metal reinforcing element 12 as guides for drilling holes in the deck joist. Once the holes are drilled in the deck joist, the composite deck post can be quickly and easily bolted or screwed to the deck joist with common hand tools.

The cost of manufacturing such a composite deck post is quite reasonable. Also, by the combination of the plastic outer shell and the steel, a strong, stiff deck post is achieved. The composite deck post constructed this way meets typical building code requirements for strength. Such building code requirements typically are not met by producing a hollow deck post of a similar shape made out of PVC alone, for example. This resulting composite deck post is quite weather-resistant, owing to the external surfaces being made of PVC, while the less weatherable element (the steel) is concealed therewithin, and the use of aluminum fasteners.

While the invention has been disclosed in a preferred form, it will be apparent to those skilled in the art that certain modifications, additions, and deletions can be made therein without departing from the spirit and scope of the invention as set forth in the appended claims. For example, other plastic materials can be used for the shell besides PVC. Also, the steel reinforcing tube can be replaced with an aluminum tube or solid metal. These and other modifications, nonetheless, fall within the scope of the invention as set forth in the following claims.

What is claimed is:

1. A composite deck post for use with a wood joist of a wood deck and for attachment thereto with at least one fastener, the composite deck post comprising:

an elongate, hollow, extruded plastic shell, said plastic shell having a width and a depth and being rectangular in cross-section and having an upper end and a lower end, said plastic shell having a notch formed therein adjacent said lower end for receiving a wood joist of a wood deck, said notch having a width and a depth; and an elongate, tubular metal stiffening member positioned within said plastic shell and extending from said lower end of said plastic shell toward, but not reaching, said upper end of said plastic shell, said metal stiffening member being rigidly secured to said plastic shell beneath and generally adjacent said upper end of said plastic shell, said plastic shell having at least one mounting hole adjacent said notch for mounting said composite deck post to the wood joist with a fastener, said metal stiffening member having at least one mounting hole aligned with said at least one mounting hole of said plastic shell and wherein said depth of said plastic shell, said depth of said notch, and said metal stiffening member are dimensioned such that an edge of said metal stiffening member protrudes into said notch or is at least coextensive with an edge of said notch.

2. A composite deck post as claimed in claim 1 wherein said at least one mounting hole comprises two mounting holes.

3. A composite deck post as claimed in claim 1 wherein said metal stiffening member is steel and has a square cross-section.

* * * * *